US006560344B1

(12) United States Patent
Julstrom et al.

(10) Patent No.: US 6,560,344 B1
(45) Date of Patent: May 6, 2003

(54) MINIATURE SURFACE MOUNTED DIRECTIONAL MICROPHONE ASSEMBLY

(75) Inventors: Stephen D. Julstrom, Chicago, IL (US); Robert B. Schulein, Evanston, IL (US); Viorel Drambarean, Skokie, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

(21) Appl. No.: 09/232,391

(22) Filed: Jan. 15, 1999

Related U.S. Application Data

(60) Provisional application No. 60/106,480, filed on Oct. 30, 1998.

(51) Int. Cl.[7] ..... H04R 25/00

(52) U.S. Cl. ..... 381/356; 381/358; 381/361

(58) Field of Search ..... 381/313, 322, 381/324, 328, 330, 356, 357, 358, 359, 360, 361

(56) References Cited

U.S. PATENT DOCUMENTS 5,216,711 A * 6/1993 Takagi et al. ..... 381/356
5,799,096 A * 8/1998 Liao ..... 381/361
5,878,147 A * 3/1999 Killion et al. ..... 381/328

* cited by examiner

*Primary Examiner*—Duc Nguyen
*Assistant Examiner*—Suhan Ni
(74) *Attorney, Agent, or Firm*—McAndrews, Held & Malloy, Ltd.

(57) ABSTRACT

The present invention relates to a motor vehicle mounted directional microphone assembly for use in hands-free cellular telecommunications. The microphone assembly is comprised of a case and a removable directional microphone module. The case is adapted to mount and lock the module in a plurality of different orientations, thereby enabling the assembly to accommodate various mounting arrangements within the vehicle. The module is releasable, however, from its locked position to permit re-orientation of the microphone with respect to the case, if desired. The module is also completely removable from the case to permit mounting of the module within the vehicle in mounting arrangements independent of the case.

47 Claims, 15 Drawing Sheets

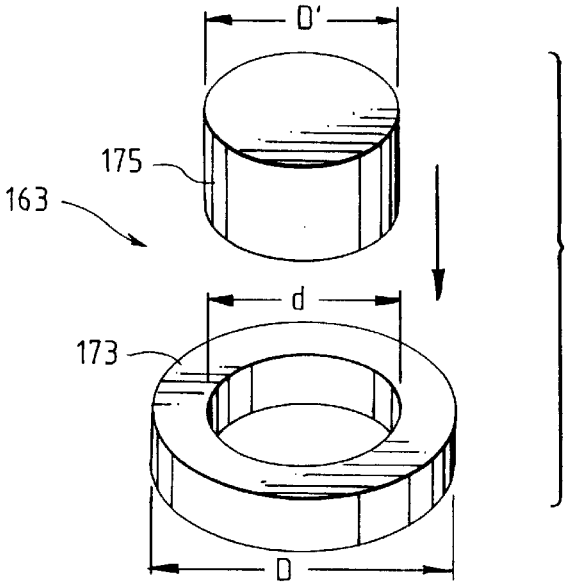
FIG. 16
FIG. 17
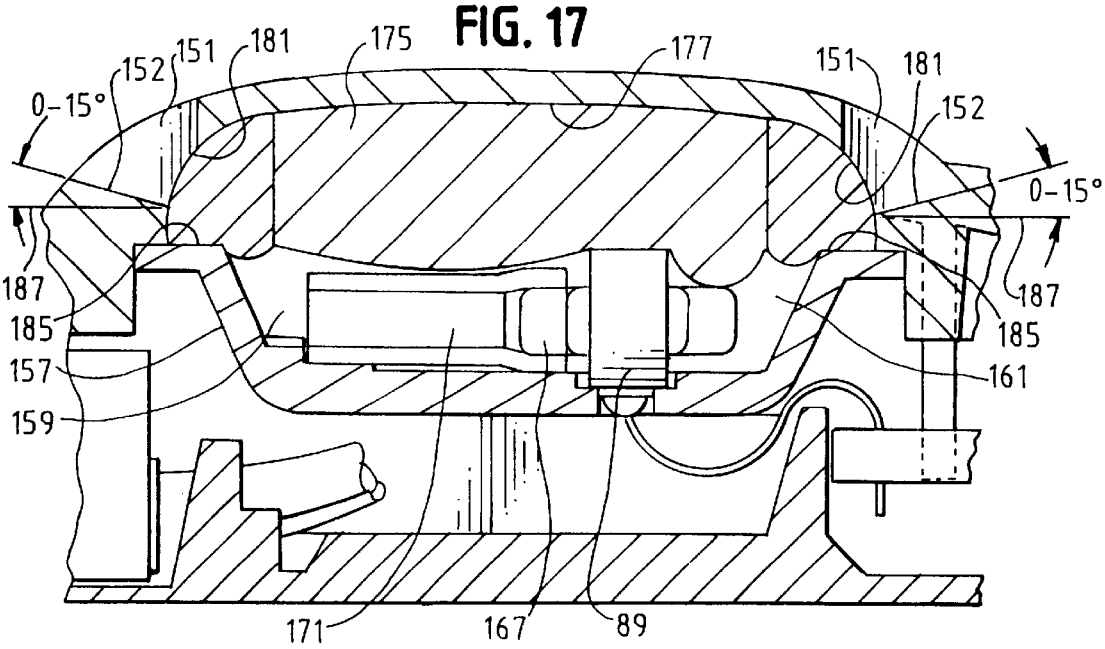
FIG. 18
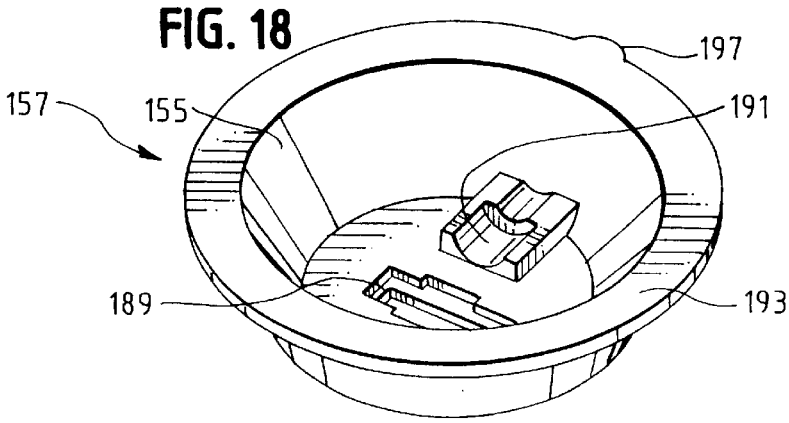

MINIATURE SURFACE MOUNTED DIRECTIONAL MICROPHONE ASSEMBLY

CROSS-REFERENCE TO RELATED APPLICATIONS

The present application is a continuation-in-part of U.S. provisional application Ser. No. 60/106,480 filed Oct. 30, 1998.

BACKGROUND OF THE INVENTION

Cellular telephones are widely used in motor vehicle environments. The use of traditional hand-held telephones in such environments, however, is often distracting to a driver and hinders the driver's ability to maneuver in traffic. Hand-held telephones, therefore, increase the risk of accident.

As a result, some motor vehicle and cellular telephone manufacturers have developed systems enabling hands-free telephone operation. Such hands-free telephone systems often employ a microphone that is mounted within the vehicle and is used to pick up speech for telephone communication and voice commands. The microphone in such systems is often coupled to a radio/telephone system located within the vehicle. The radio/telephone system generally comprises a traditional cellular telephone system that is coupled to a vehicle radio in such manner to enable the use of the radio amplifier and speakers for listening to incoming telephone audio. The telephone/radio system also provides power to, and receives electrical voice signals from, the microphone.

In operation, a driver typically presses a button on the radio or on the microphone to establish hands-free use. The driver is then able to listen to a caller's voice via the radio speakers and speak freely without being required to manipulate or hold a telephone. The driver's speech is transduced to electrical signals by the microphone, which electrical signals are transferred to the radio/telephone system and then to the caller via the vehicle cellular telephone system.

A number of different microphone assemblies have been developed for such hands-free motor vehicle applications. For example, omnidirectional microphone assemblies have been mounted on interior surfaces of automobiles, typically in two locations—at a forward, central headliner position and at or near the top of the driver side roof support pillar (A-pillar). By their nature, however, omnidirectional microphones pick up sound from all directions, and thus their performance in motor vehicle applications often suffers due to the numerous non-speaker noise sources in the vehicle, such as, for example, the ventilation system, the defroster, other people speaking, etc.

Directional microphones have also been developed for motor vehicle applications, and can produce significant performance advantages over omnidirectional microphones. A typical prior art directional microphone assembly is illustrated in FIG. 1. A microphone 1 is mounted behind a surface 3, which may form part of a mostly acoustically opaque housing or a mostly acoustically transparent grill cover. The front of the element diaphragm is acoustically coupled through tube 5 and surface inlet 7 to the acoustic pick-up region 9. Similarly, the rear of the diaphragm is acoustically coupled through tube 11 and surface inlet 13 to the acoustic pick-up region 9. Tubes 5 and 11 are narrow, generally cylindrical and substantially resonant over the desired frequency range. Acoustic resistor 15 in tube 11 and the enclosed rear volume 17 behind the diaphragm, form a low-pass filter/delay for sound entering surface hole 13. This delay, along with the dimensions of tubes 5 and 11 and the distance between surface inlets 7 and 13, forms a first-order directional pickup pattern in the pick-up region 9 that is directed along a line from surface inlet 13 to surface inlet 7.

Thus, because of the directivity of the pickup, directional microphones generally require that much greater skill and care be used in positioning the microphone within a motor vehicle in order to achieve the aforementioned performance advantages over omnidirectional microphones. Like omnidirectional microphones, directional microphones have also typically been positioned at a forward central headliner location and at or near the top of the A-pillar in motor vehicle applications. Unlike omnidirectional microphones, however, if a directional microphone is improperly installed in those locations, the performance of the microphone can be adversely affected. Similarly, if a directional microphone designed for those locations is installed in another location for which the microphone is not suited, or if the microphone position is modified by the consumer, the performance may also suffer.

It is desirable, therefore, that a microphone assembly design address these installation concerns to maximize directional microphone performance without requiring that an acoustic expert be involved in the installation of the microphone. In addition, it is also desirable that any such design be adaptable to enable flush mounting with any number of existing surfaces in the vehicle, if the vehicle manufacture requires such mounting for aesthetic reasons.

Consequently, it is an object of the present invention to provide a microphone assembly that can easily and properly be installed at the typical headliner and A-pillar locations as well as any number of other locations in the vehicle, and that can accommodate both left and right drive vehicles.

It is another object of the present invention to provide a microphone assembly that can be easily modified for proper installation at different locations but is not easily disturbed by a consumer.

It is a further object of the present invention to provide a microphone assembly that can easily be adapted for flush mounting with any number of surfaces within the vehicle.

BRIEF SUMMARY OF THE INVENTION

These and other objects of the invention are achieved in a directional microphone assembly having a case and a removable directional microphone module. The case is adapted to mount and lock the module in place thereon in a plurality of different orientations. The directional microphone module is removable from the case and may be re-oriented thereon to accommodate different desired mounting arrangements.

The removable directional microphone module is comprised of a directional microphone element having front and rear inlet ports that are acoustically coupled to front and rear inlet paths, respectively. Sound from a pickup region enters the front and rear inlet paths and is coupled via the front and rear inlet ports to front and rear microphone chambers defined in part by a microphone diaphragm.

In one embodiment, front and rear acoustic plugs are located in the front and rear sound inlet paths. The front and rear acoustic plugs are, for example, made of sintered porous plastic or open cell acoustic foam material. A windscreen made of a cloth or screen material may also be located over the acoustic plugs. The windscreen and acoustic plugs generally operate together to protect against dirt, dust, moisture, etc. and cut down on wind noises.

In another embodiment, the front and rear inlet paths are generally non-cylindrical in shape. The inlet paths are substantially non-resonant in a frequency range of desired sound pickup.

In a further embodiment, the removable directional microphone module includes a housing. The microphone element is mounted in the housing, and the front and rear sound inlet paths are formed in the housing. Recesses in the housing receive the front and rear acoustic plugs such that the front and rear acoustic plugs are located, respectively, in the front and rear inlet paths. The acoustic plugs may, when inserted in the recesses, form portions of a top surface of the housing. A windscreen then may be attached to the top surface of the housing.

In a still further embodiment, the case includes at least one mounting surface and a plurality of index notches. The removable directional microphone module likewise includes at least one index tab. When the module is mounted on the mating surface, the index tab engages one of the index notches, depending on the desired orientation of the microphone. The module is then "locked" in the selected orientation, but releasable therefrom. The index notches may, for example, be equally spaced at every 30° around the mounting surface, thereby enabling flexible orientation of the microphone within the case. The module is also removable from its mounted relationship with the case to enable re-orientation of the microphone and/or support different mounting arrangements.

These and other advantages and novel features of the present invention, as well as details of an illustrated embodiment thereof, will be more fully understood from the following description and drawings.

BRIEF DESCRIPTION OF THE SEVERAL VIEWS OF THE DRAWING

FIG. 16 illustrates a windscreen built in accordance with the alternate embodiment.

FIG. 17 illustrates a partial cross-sectional view of the cover and removable module of FIGS. 14*a* and 14*b*.

FIG. 18 illustrates the removable module of the alternate embodiment removed from the cover.

DETAILED DESCRIPTION OF THE INVENTION

Figure 2A:
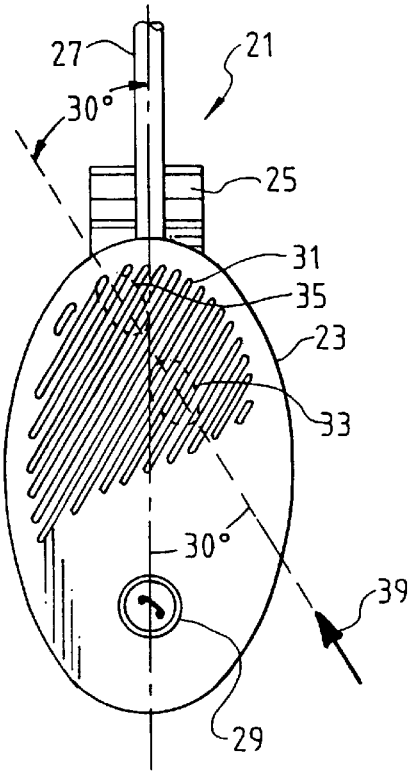
FIG. 2*a* illustrates a front view of a microphone assembly built in accordance with the present invention for headliner mounting in a left drive vehicle.
Figure 2B:
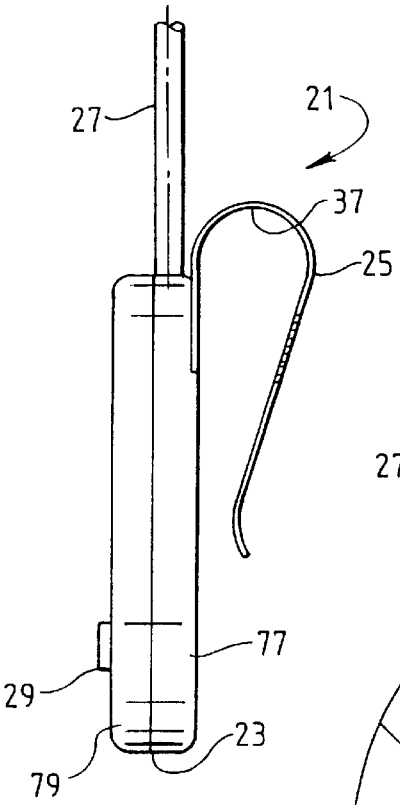
FIG. 2*b* illustrates a side view of the microphone assembly of FIG. 2*a*.
Figure 2C:
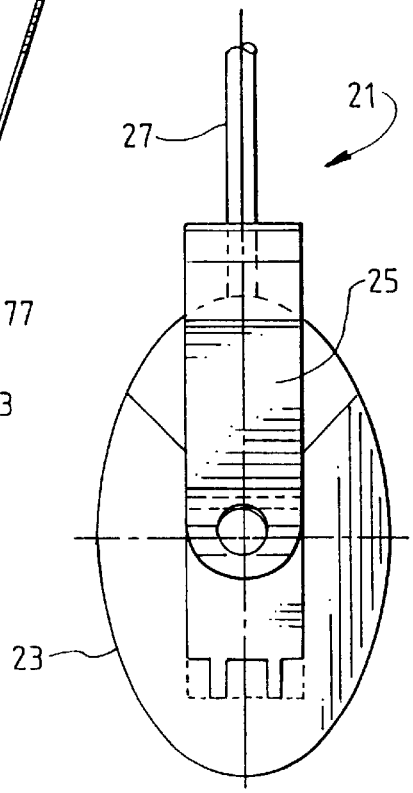
FIG. 2*c* illustrates a rear view of the microphone assembly of FIG. 2*a*.

FIGS. 2*a*, 2*b* and 2*c* illustrate front, side and rear views, respectively, of a microphone assembly 21 of the present invention for headliner mounting in a left drive vehicle. Microphone assembly 21 includes a case 23 and a mounting bracket 25. The case 23 has a grill portion 31, behind which sound inlet ports 33 and 35 are located. As explained more completely below, sound inlet ports 33 and 35 acoustically couple sound to a microphone element (not shown) located within the case 23. A cable 27 electrically connects the microphone element to a radio/telephone system located within the vehicle. A button switch 29 is used to initiate or end a telephone call.

The case 23 is mounted generally at a forward, center headliner location in a vehicle approximately near the rear view mirror. The headliner, as understood in the automotive industry, is the material that is attached to the inner metal ceiling of the vehicle. For aesthetic and practical mounting considerations, it is desirable to keep the case 23 at one mounting position (horizontally straight back) and to keep the switch 29 at the back of the case 23 (i.e., closer to the driver). The bracket 25 is therefore designed to be inserted underneath the headliner so that the case 23 rests on the outer surface of the headliner material. In other words, when the assembly 21 is installed, the headliner is located between the bracket 25 and the case 23, and the case 23 rests on the ceiling of the car. The bracket 25, being generally straight, enables the microphone assembly 21 to be maintained in a horizontally straight back position when the microphone assembly 21 is firmly installed (i.e., when the headliner contacts a surface 37 of the bracket 25).

For such headliner mounting, however, we have determined that the optimum acoustical orientation of the microphone is horizontally straight back, but with a slight angling of approximately 30° towards the driver location. Such angling enables driver voice pickup (the driver generally sits farther forward than the passenger) while still enabling passenger voice pickup. To achieve such angling while maintaining the horizontally straight back positioning of the case, sound inlet ports 33 and 35 are oriented approximately 30° off the horizontally straight back axis as seen in FIG. 2*a*. Sound inlet port direction of maximum sensitivity is shown generally by arrow 39.

Figure 3A:
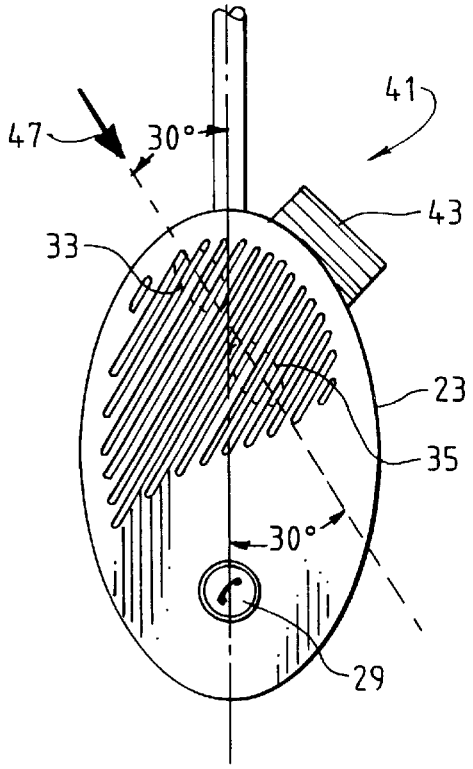
FIG. 3*a* illustrates a front view of a microphone assembly built in accordance with the present invention for A-pillar mounting in a left drive vehicle.
Figure 3B:
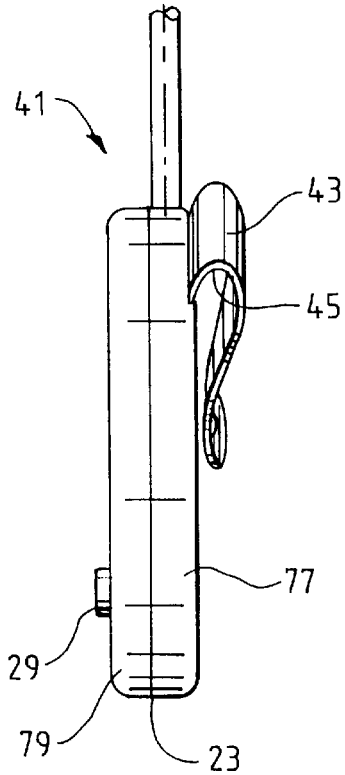
FIG. 3*b* illustrates a side view of the microphone assembly of FIG. 3*a*.
Figure 3C:
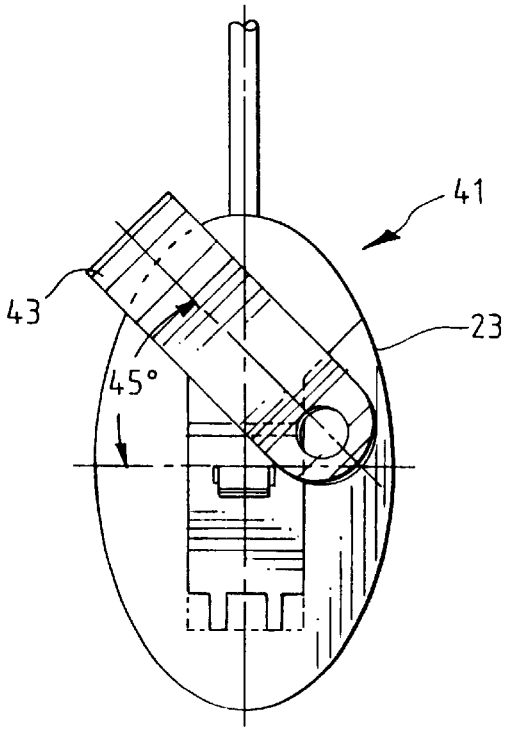
FIG. 3*c* illustrates a rear view of the microphone assembly of FIG. 3*a*.

FIGS. 3*a*, 3*b* and 3*c* illustrate front, side and rear views, respectively, of a microphone assembly 41 of the present invention for A-pillar mounting in a left drive car. The microphone assembly 21 is virtually identical to the microphone assembly 21 of FIG. 2, except for bracket 43 and the orientation of the sound inlet ports 33 and 35. In this embodiment, the case 23 is mounted at or near the top of the vehicle driver A-pillar. The A-pillar, as understood in.the automotive industry, is the windshield roof support pillar. In the interior of the vehicle, the A-pillar is typically covered by a plastic piece, much like the metal roof is covered by the headliner material. For aesthetic and practical mounting considerations, it is similarly desirable to keep the case 23 at one mounting position (in-line with the A-pillar) and to keep the switch 29 at the bottom of the case (i.e., closer to the driver). Aligning the case 23 with the A-pillar results in a more stable mounting. If the case 23 were mounted so that it cut across the A-pillar then the case 23 could rock back and forth, resulting in a degradation of performance. The bracket 43 is therefore designed to be inserted underneath the plastic piece mounted on the A-pillar so that the case 23 rests on the outer surface of that plastic piece. In other words, when the assembly 41 is installed, the A-pillar plastic piece is located between the bracket 43 and the case 23, and the case 23 rests on the A-pillar support. The bracket 43 is angled at a 45° angle to the case 23 (see FIG. 3*c*) to maintain the case aligned with the A-pillar when the microphone assembly 41 is firmly installed (i.e., when the A-pillar plastic piece contacts a surface 45 of the bracket 43).

For such A-pillar mounting, we have determined that the optimum acoustical orientation of the microphone is horizontally straight back. Such orientation provides the best compromise between driver speech pickup and dashboard noise (e.g., from the ventilation system, the defroster, the audio speakers, etc.). The combination of the 45° angle of the bracket and a 30° off-axis orientation of the sound inlet ports (see FIG. 3*a*) closely approximates the desired horizontally straight back acoustical orientation. However, as can be seen in FIG. 3*a*, the sound inlet ports are rotated 180° from their location in FIG. 2*a*, such that sound inlet port direction is now shown by arrow 47.

Figure 4A:
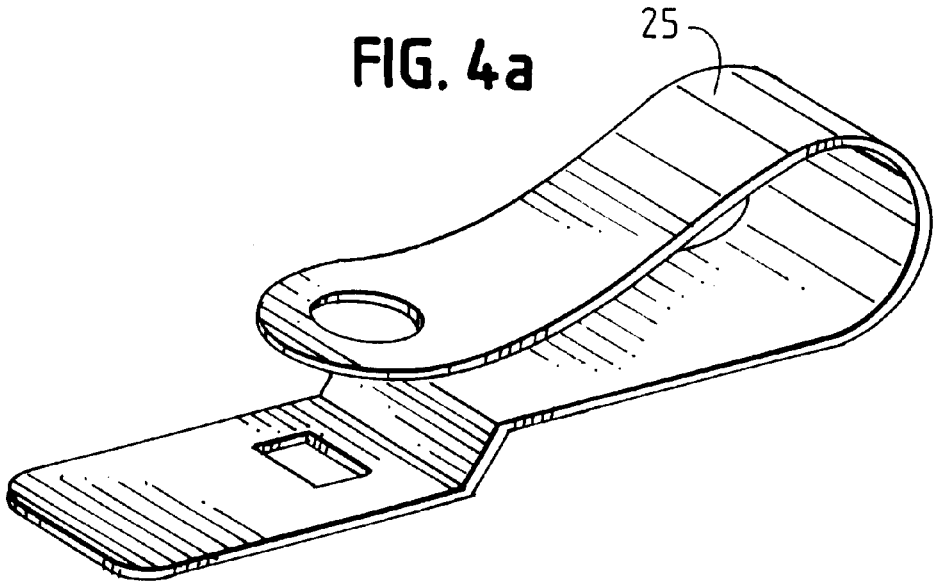
FIG. 4*a* illustrates a bracket design for A-pillar mounting in accordance with the present invention.
Figure 4B:
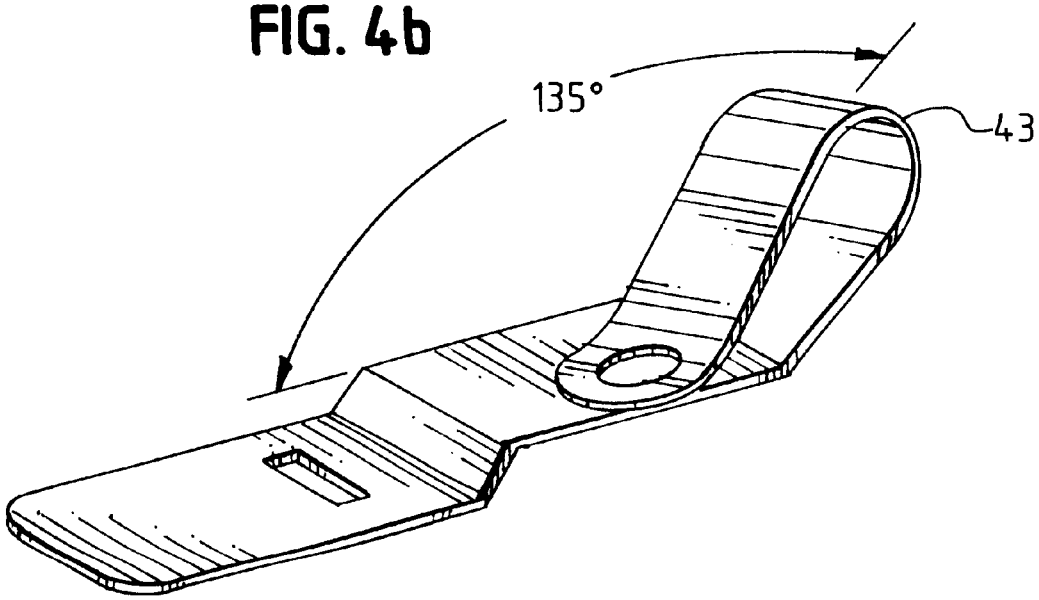
FIG. 4*b* illustrates a bracket design for headliner mounting in accordance with the present invention.

Thus as is apparent, different clips are used to establish and maintain proper alignment for both mounting locations while using essentially the same microphone. FIGS. 4*a* and 4*b* illustrate brackets 25 and 43 of FIGS. 2*a*–2*c* and FIGS. 3*a*–3*c*, respectively. Bracket 25, as mentioned above, is generally straight. Bracket 43 is formed at a 135° angle as shown so that the bracket 43 maintains a 45° angle to the case 23 as shown in FIG. 3*c*. As discussed more completely below, clips 25 and 43 are interchangeable and can be used with the same microphone assembly case.

Figure 5A:
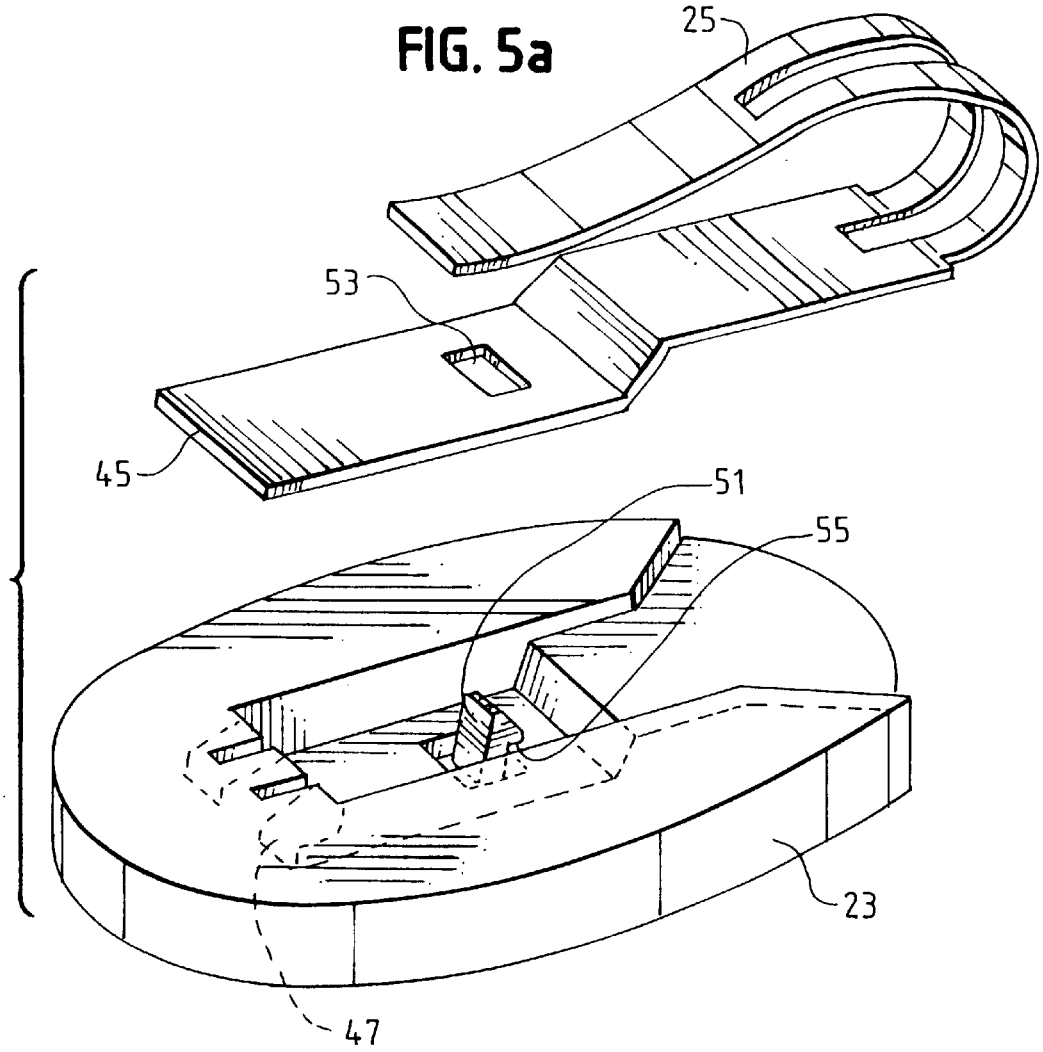
FIGS. 5*a* and 5*b* illustrate one embodiment of a bracket mounting and release arrangement in accordance with the present invention.
Figure 5B:
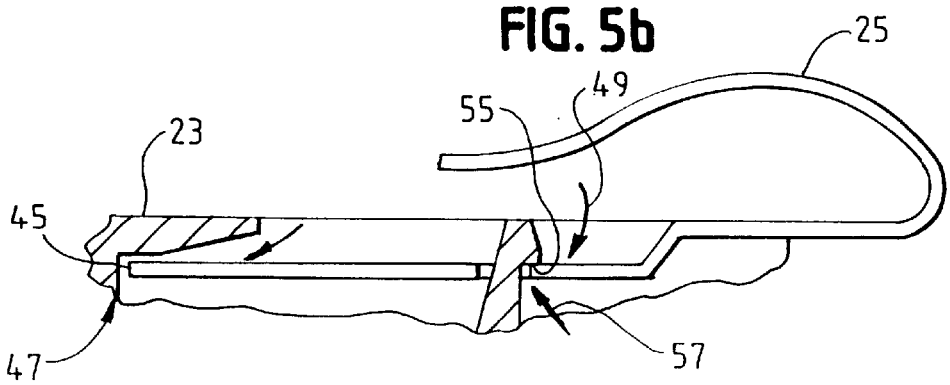

FIGS. 5*a* and 5*b* illustrate one embodiment of a bracket mounting and release arrangement in accordance with the present invention. FIG. 5*a* illustrates the rear of case 23 with clip 25 disassembled therefrom. FIG. 5*b* illustrates a side cross sectional view of the bracket 25 in a mounted position on the case. For assembly, an end 45 of bracket 25 is placed in a recess 47 of case 23. The bracket 25 is then rotated down in a direction of arrow 49 in FIG. 5*b*. A retaining member 51 mates with an opening 53 in the bracket 25 until a portion of the bracket 25 adjacent the opening 53 is received under a surface 55 of the retaining member 51, as shown in FIG. 5*b* by an arrow 57. The retaining member 51 is moveable and performs a spring type retaining function in that the bracket 25 is "snapped" into place onto the case 23 when the bracket 25 portion becomes engaged under the surface 55 of the retaining member 51.

The retaining member 51 is also releasable, permitting the bracket 25 to be easily removed from the case 23 by movement of the retaining member 51 and release of the bracket 25 portion from engagement under the surface 55 of the retaining member 51. Bracket 43 may also be mounted on the case 23 and released therefrom in the same manner discussed above with respect to bracket 25.

Figure 6A:
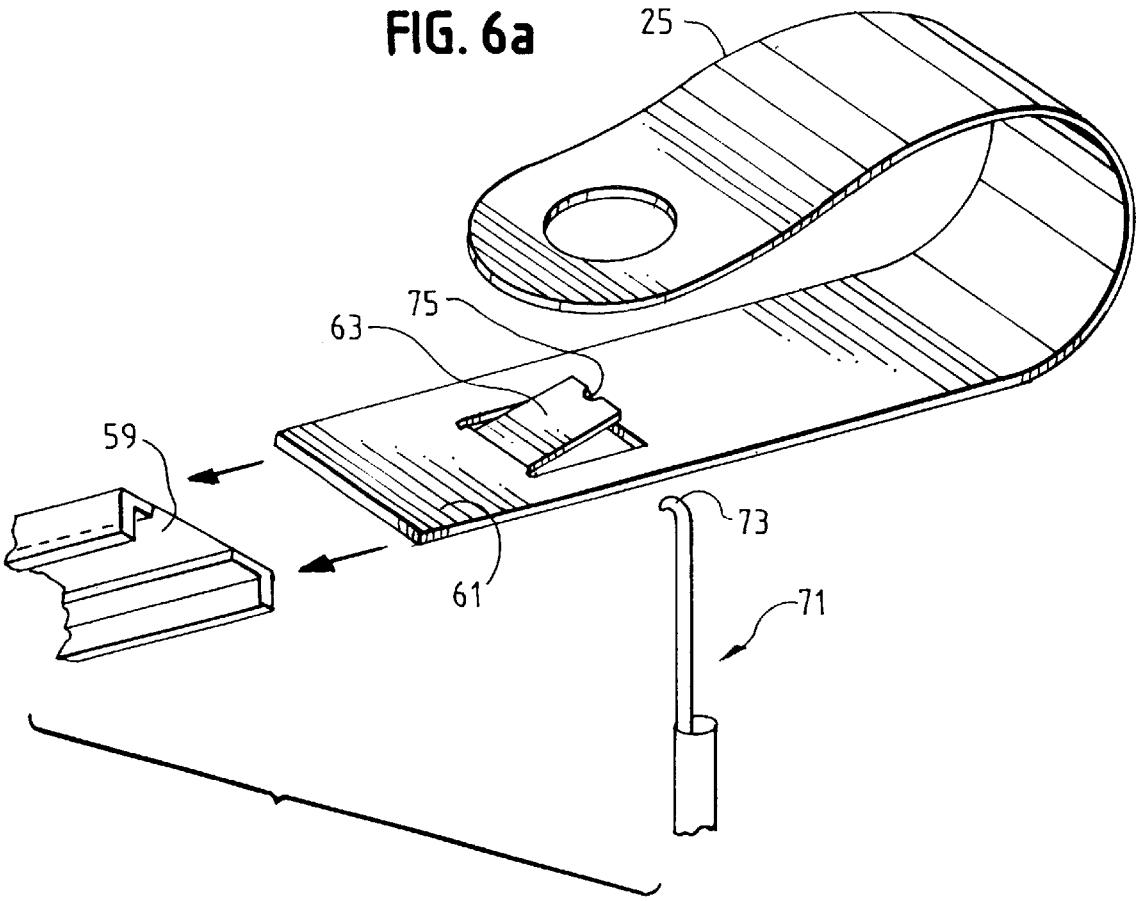
FIGS. 6*a* and 6*b* illustrate another embodiment of a bracket mounting and release arrangement in accordance with the present invention.
Figure 6B:
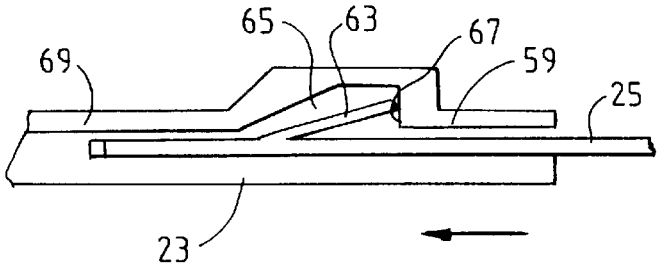

FIGS. 6*a* and 6*b* illustrate another embodiment of a bracket mounting arrangement in accordance with the present invention. FIG. 6*a* illustrates a mounting sleeve 59 that is located on the rear of case 23 with bracket 25 disassembled from the sleeve 59. FIG. 6*b* illustrates a side cross sectional view of bracket 25 inserted into the sleeve 59 and in an assembled position on the case 23. During assembly, an end 61 of the bracket 25 is inserted in a horizontal direction into the sleeve 59. A retaining member 63 becomes depressed as it enters the sleeve 59, enabling the end 61 of the bracket 25 to be moved toward an end 69 of the sleeve 59. The retaining member 63 regains its preassembled shape when it enters a recess 65 in the sleeve 59. In that position, a wall 67 that defines a portion of the recess 65 acts as a mechanical stop to prevent the bracket 25 from being removed from the sleeve 59 by virtue of the engagement of retaining member 63 against the wall 67. Like the embodiment of FIGS. 5*a* and 5*b*, the retaining member 63 is also movable and similarly performs a spring-type retaining function in that the bracket 25 is snapped into place onto the case 23 when the retaining member 63 regains its preassembled shape upon entering the recess 65.

The retaining member 63 is also, like the embodiment of FIGS. 5*a* and 5*b*, releasable. In this embodiment, however, the bracket 25 is removed from the sleeve 59 (and thus the case 23) by manipulation of tool 71. More specifically, a hook end 73 of tool 71 is used to engage a recess 75 on retaining member 63. The retaining member 63 is then pulled down so that it can clear wall 67, and the bracket 25 can be removed by pulling it in a horizontal direction out of the sleeve 59. Again, bracket 43 may also be mounted on case 23 and released therefrom in the same manner discussed immediately above with respect to bracket 25.

Figure 7A:
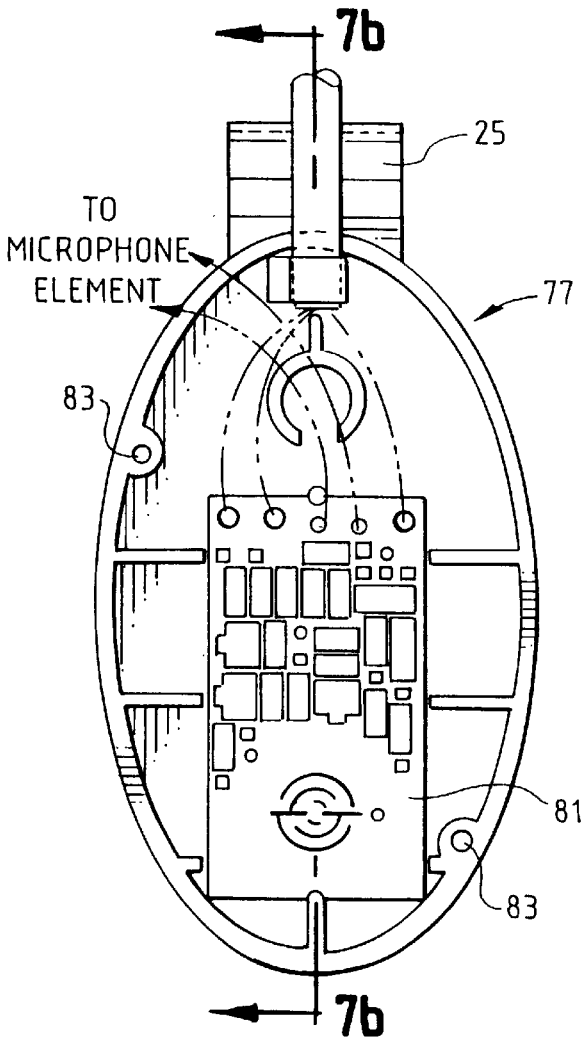
FIG. 7*a* illustrates an inside view of a base portion of a case built for headliner mounting in accordance with the present invention.
Figure 7B:
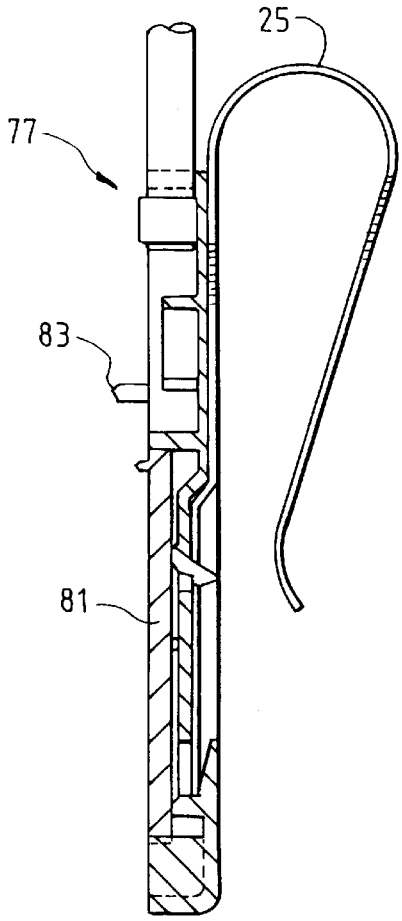
FIG. 7*b* is a cross-sectional view of the base of FIG. 7*a* taken along lines B—B.

As can be best seen in FIGS. 2*b* and 3*b*, case 23 is comprised of a base 77 and a cover 79. FIG. 7*a* illustrates an inside view of base 77 of case 23 for microphone assembly 21. FIG. 7*b* is a cross sectional view of the base 77 taken along lines B—B of FIG. 7*a*. As can be seen, base 77 has bracket 25 in a mounted position thereon. A printed circuit board 81 is mounted on the inside of base 77 and electrically connects a microphone element (not shown) to the radio/telephone system of the vehicle via cable 27, as discussed above. The base 77 includes mating members 83 that engage recesses 85 (see FIG. 86) on the cover 79 to snap fit the base 77 and cover 79 together to form the case 23.

Figure 8A:
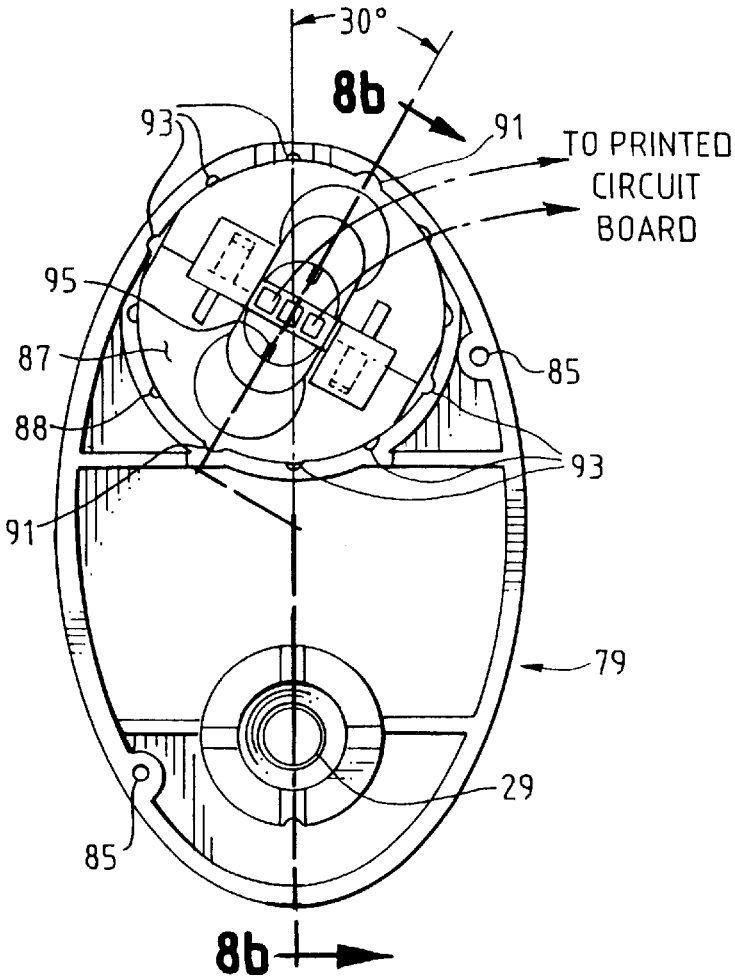
FIG. 8*a* illustrates an inside view of a cover portion of the case built for headliner mounting in accordance with the present invention.
Figure 8B:
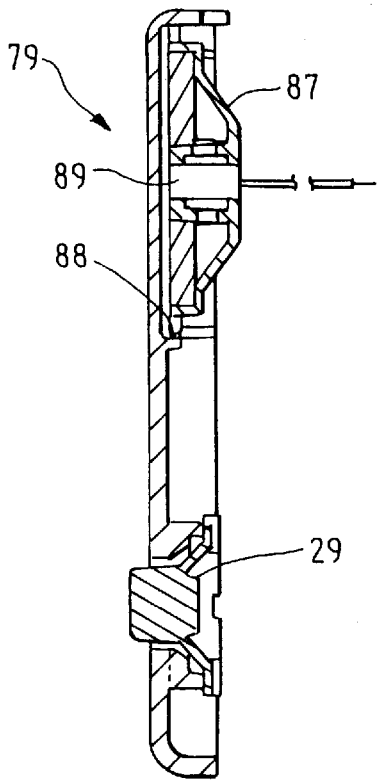
FIG. 8*b* is a cross-sectional view of the cover of FIG. 8*a* taken along lines A—A.
Figure 9A:
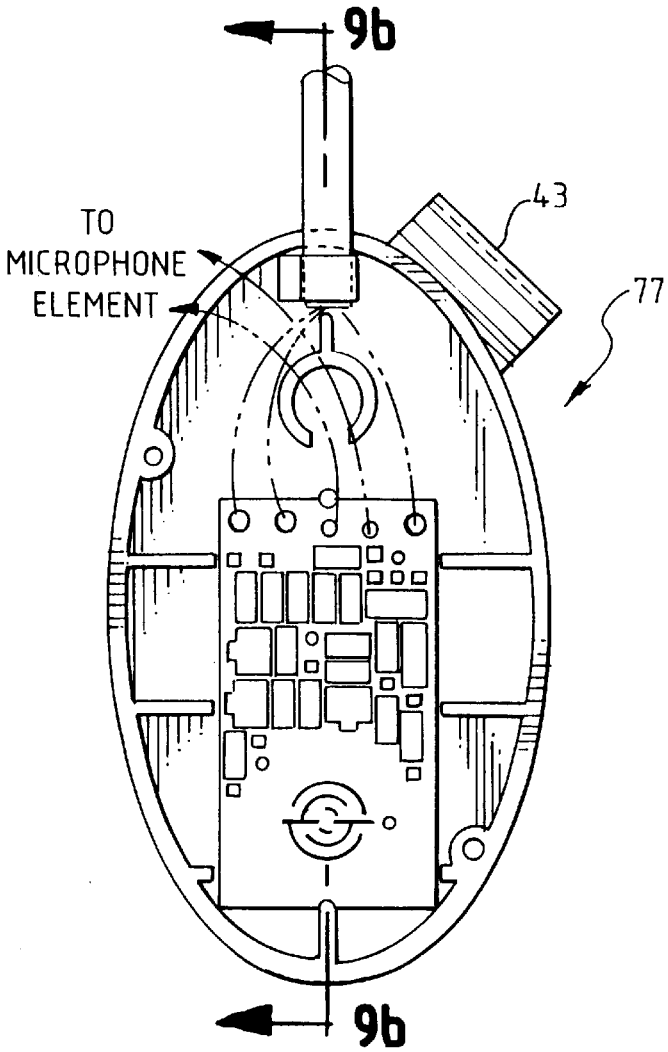
FIG. 9*a* illustrates an inside view of a base portion of a case built for A-pillar mounting in accordance with the present invention.
Figure 9B:
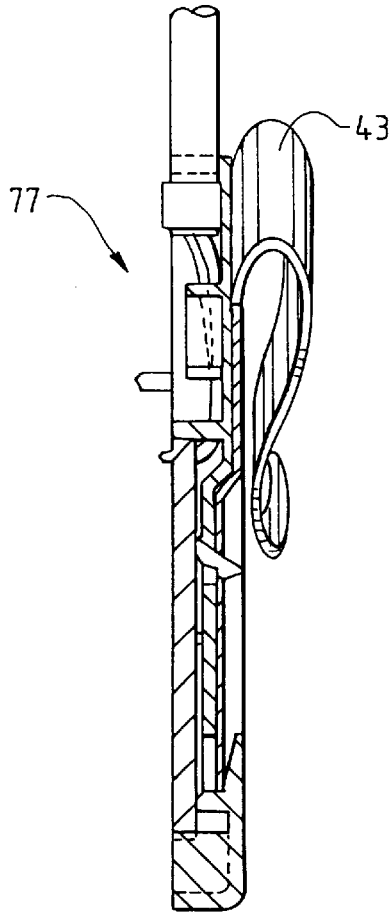
FIG. 9*b* is a cross-sectional view of the base of FIG. 9*a* taken along lines B—B.
Figure 10A:
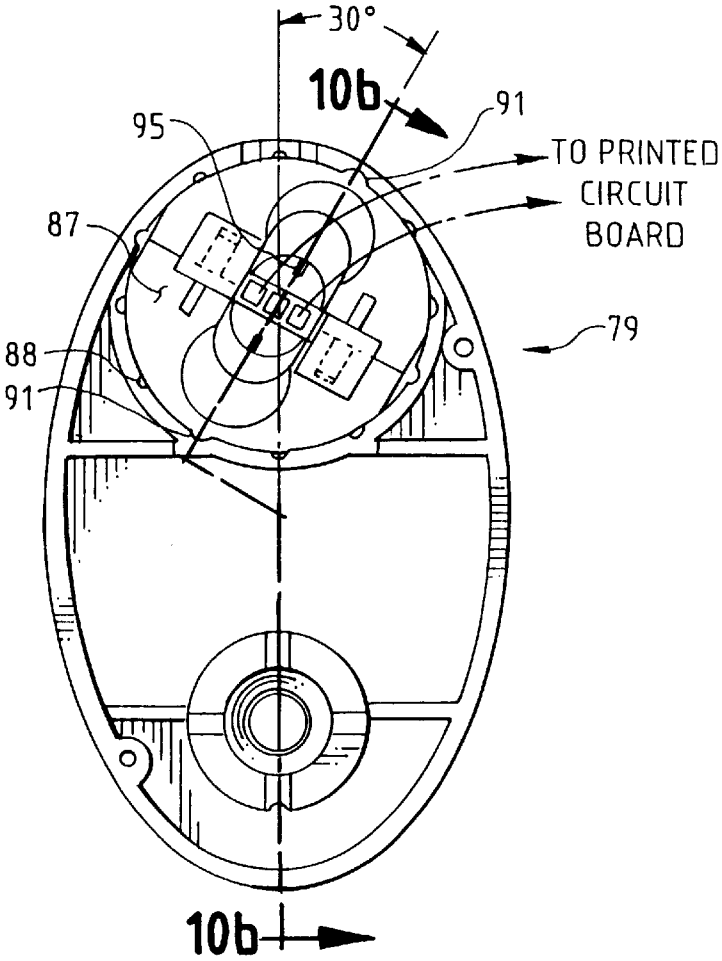
FIG. 10*a* illustrates an inside view of a cover portion of the case built for A-pillar mounting in accordance with the present invention.
Figure 10B:
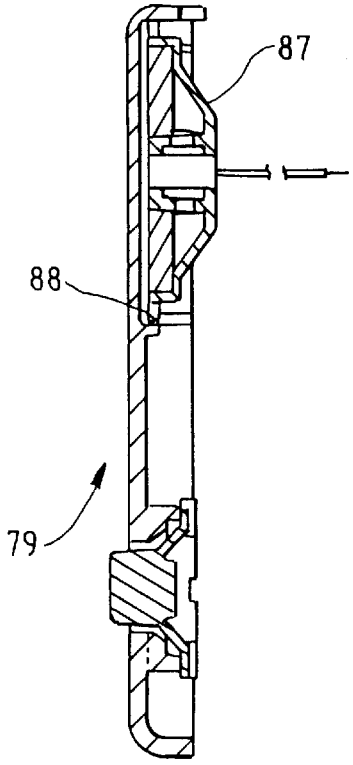
FIG. 10*b* is a cross sectional view of the cover of FIG. 10*a* taken along lines A—A.

FIG. 8*a* illustrates an inside view of cover 79 of case 23 for microphone assembly 21. FIG. 7*b* is a cross sectional view of the cover 79 taken along lines A—A of FIG. 8*a*. As mentioned above, cover 79 includes recesses 85 that receive the mating members 83 of base 77 during snap assembly of the base 77 and cover 79 into case 23. Cover 79 further includes a button switch 29, also as mentioned above. Cover 79 also includes a directional microphone subassembly or module 87 having a microphone element 89 that is electrically connected to the printed circuit board 81, again as mentioned above. The microphone element may be, for example, one manufactured by Knowles Electronics.

The microphone module 87 is generally circular in shape and is mounted on at least one generally circular mounting surface 88 of the cover 79. Microphone module 87 and surface 88 could be other shapes, however. Microphone module 87 can be removed as a unit from the mounting surface 88 and rotated for various mounting orientations in the cover 79. The microphone module 87 includes two index tabs 91 that engage any two of index notches 93 located in the cover 79 when the module 87 is placed in a mounted position in cover 79. The microphone module 87 may, of course, alternatively include only one index tab or more than two index tabs. The index notches 93 are located at, for example, every 30° around the mounting surface 88 of cover 79. Location of the index notches as such enables proper installation of module 87 into the cover 79 without requiring angle measurements.

In an alternative embodiment, the microphone module 87 and mounting surface 88, instead of having index tabs and notches, respectively, could be identically shaped and adapted to mate together only when the microphone is oriented at certain angles with respect to the cover 79. More particularly, the module may be, for example, a twelve-sided convex polygon having sides of equal length. The mounting surface or recess would be the same shape and adapted to receive the module in mating relation. In this configuration, each time the module is rotated one position and is mated with the mounting surface, the change in the direction of the microphone orientation is 30° from that of the previous mounted position. A simple counting of sides and rotation of the module, therefore, could easily provide the orientation function of the index tabs and notches discussed above.

Microphone module 87 also includes a microphone entry reference port 95. The reference port 95 is preferably color coded or otherwise identified. Thus, during assembly, depending on the mounting arrangement of the microphone assembly desired, an assembler can quickly and easily set the proper position of the microphone module for desired performance.

For example, if a headliner mounting is desired, the manufacturer simply counts one index notch over from the vertical axis of the cover, makes sure the reference port 95 is facing the proper direction, and places the microphone module 87 into the mounting surface 88 of the cover 79, mating the index tabs 91 into the selected index notches. The microphone module 87 is then locked into place on the mounting surface 88. The remainder of the case 23 is assembled as discussed above, and then bracket 25 is added.

If instead an A-pillar mounting is desired, the assembler similarly counts one notch over from the vertical axis of the cover, makes sure the reference port is facing the proper direction (i.e., 180° from the direction for headliner mounting) and places the microphone module 87 into the mounting surface 88 of the cover 79, mating the index tabs 91 into the selected index notches. The microphone module 87 is then locked into place on the mounting surface. Again, the remainder of the case 23 is assembled as discussed above, but this time bracket 43 is added.

FIGS. 9A, 9*b*, 10*a* and 10*b* illustrate a base inside view, a base cross-sectional view, a cover inside view and a cover cross sectional view, respectively, of microphone assembly 41 for such A-pillar mounting arrangement. As can be seen, these figures are virtually identical to FIGS. 7*a*, 7*b*, 8*a* and 8*b*, respectively, for headliner mounting, except that module 87 is rotated 180° (see reference port 95), and bracket 43 is used instead of bracket 25.

Thus, the module 87 mounting system of the present invention allows virtually any relationship between acoustical orientation and microphone assembly mounting arrangement while using essentially the same parts. For example, the present invention accommodates right drive cars. Specifically, if headliner mounting for a right drive care were desired, the assembler would simply rotate the microphone module 87 orientation 60° (i.e., two notches) counter-clockwise from its orientation for left drive cars. The same bracket 25 would be used. If A-pillar mounting for a right drive car were instead desired, the assembler would again simply rotate the microphone module 87 orientation 60° (i.e., two notches) counter-clockwise from its orientation for left drive cars. The bracket 43 would then be modified such that it forms a 45° angle to the case in the other direction as that shown in FIG. 3c (i.e., clockwise 90° from its position for left drive cars).

Furthermore, the module 87 module system of the present invention allows new and different microphone assembly mounting arrangements (i.e., other than headliner and A-pillar) without changing the design. Moreover, no particular acoustic or microphone expertise or skill is required to manufacture or assemble the product for each mounting arrangement. Further, because the module 87 is lockable by virtue of the mating of the index tabs into the index notches, it is difficult for an installer or consumer to unknowingly modify the microphone orientation within the case and thus adversely affect the microphone performance.

In addition, because the microphone module is releasable from the mating surface 88, an existing microphone assembly can quickly and easily be modified to accommodate a different mounting arrangement. In fact, the microphone module 87 component of the microphone assembly can be removed and used separately from that assembly to accommodate even additional mounting arrangements. For example, the microphone module 87 can be flush mounted as part of a separate surface grill structure in a vehicle. Such surfaces might include the dashboard, the console, etc. The same design, therefore, accommodates different interior styling requirements of different automobile manufacturers.

Figure 11A:
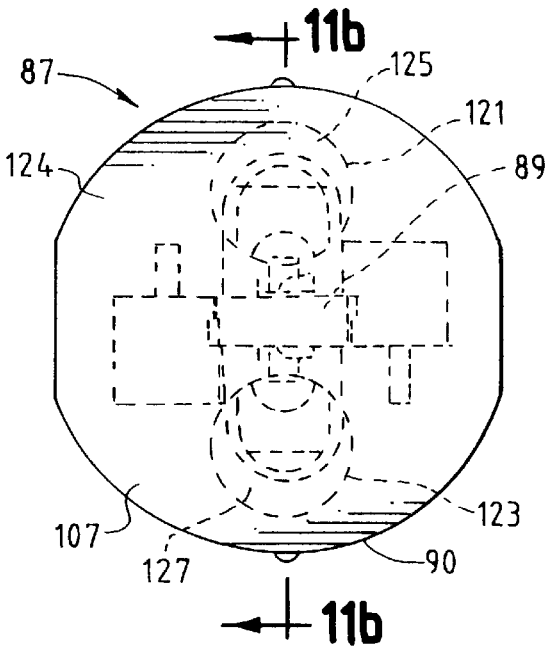
FIG. 11*a* is a top view of the microphone module of the present invention.
Figure 11B:
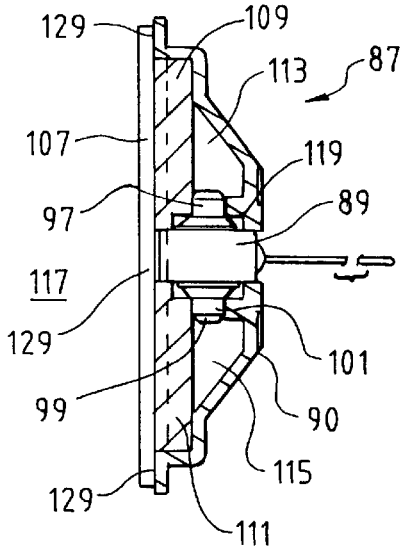
FIG. 11*b* is a side cross sectional view of the module taken along lines A—A of FIG. 11*a*.
Figure 11C:
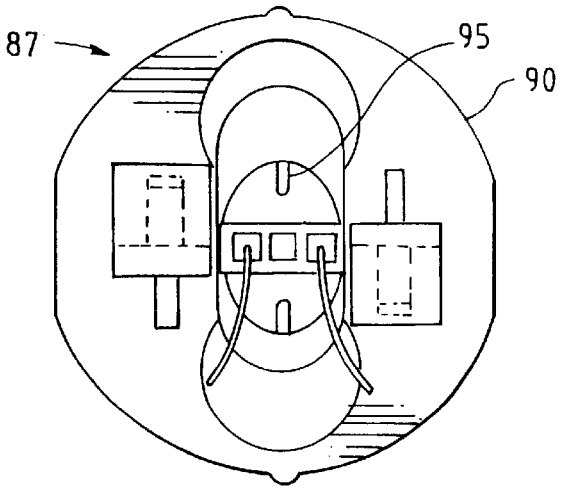
FIG. 11*c* is a bottom view of the microphone module of the present invention.

FIGS. 11*a*, 11*b* and 11*c* illustrate the microphone module 87 of the present invention. FIG. 11*a* is a top view of the module 87. FIG. 11*b* is a side cross sectional view of the module 87 taken along lines A—A in FIG. 11*a*. FIG. 11*c* is a bottom view of the module 87.

The module 87 includes a housing 90 and a microphone element 89 mounted therein. The microphone element 89 has a front inlet port 97 and a rear inlet port 99. An acoustic resistor 101 is located in rear inlet port 99. Sound is acoustically coupled to the front and rear inlet ports 97 and 99 through windscreen 107 (optional) and sound inlet paths 113 and 115, respectively. Acoustic plugs 109 and 111 are located in, and form a part of, sound inlet paths 113 and 115, respectively. To ensure that only sound from acoustic pickup region 117 enters into the front and rear inlet ports 97 and 99, a sealing material 119 is placed at locations where the housing 90 and the microphone element 89 contact. Acoustic plugs 109 and 111 fit into recesses 121 and 123, respectively, located in a top surface 124 of housing 90 (with, of course, windscreen 107 removed). Acoustic plugs 109 and 111 sit on surfaces 125 and 127, respectively, located in the recesses 121 and 123, and form part of the top surface 124.

Figure 12:
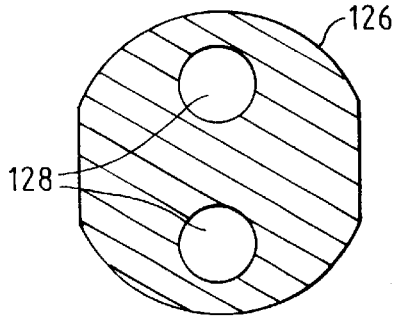
FIG. 12 illustrates a bottom surface of a windscreen that seats on a top surface of the microphone module of the present invention.

Windscreen 107 is then positioned on the top surface 124 and adhered thereto. Adhesive is used on an entire bottom surface 126 of windscreen 107 except that portion 128 generally located over recesses 121 and 123 (see FIG. 12). In other words, the bottom surface 126 of windscreen 107 is adhered to the entire top surface 124 of housing 90 except for that portion formed by acoustic plugs 109 and 111. Some overlap of adhesive over acoustic plugs 109 and 111 may be desirable, however, to prevent sound from entering into sound inlet paths 113 and 115, respectively, via paths between surfaces of the plugs and surfaces of the recesses.

Windscreen 107 is preferably made of a material having low acoustic resistance, such as, for example, cloth, open cell acoustic foam, sintered porous plastics, or screen material. Acoustic plugs 109 and 111 are preferably open cell acoustic foam material. Such material has generally a higher and better controlled acoustical resistance than a cloth material. Both the windscreen and acoustic plugs are preferably water repellant. The windscreen and acoustic plugs operate together to both protect against dirt, dust, liquids, etc. from entering sound inlet paths 113 and 115, as well as against wind noises.

The use of acoustic plugs 109 and 111 provides better wind filtering for the microphone module 87. However, their use also affects the polar pattern of the microphone module 87 as a whole. Consequently, the acoustic resistance of the acoustic resistor 101, as well as the effects of the acoustic resistance of the acoustic plugs 109 and 111, should be considered to achieve an overall desired polar pattern. Acoustic resistor 101 may have a value of 400 ohms, for example, to achieve such a desired polar pattern.

Figure 1:
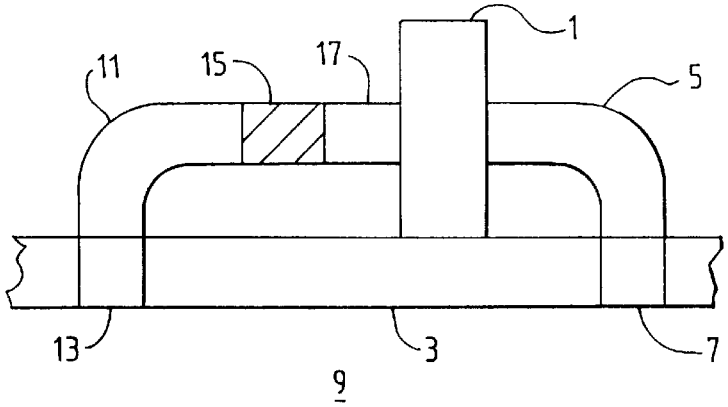
FIG. 1 PRIOR ART
FIG. 1 illustrates a typical prior art directional microphone assembly.

As can best be seen in FIG. 11*b*, sound inlet paths 113 and 115 are not, unlike the prior art in FIG. 1, cylindrical or a narrow tube as such. Therefore, the sound inlet paths 113 and 115 are substantially nonresonant in the audio frequency range of interest.

Figure 13:
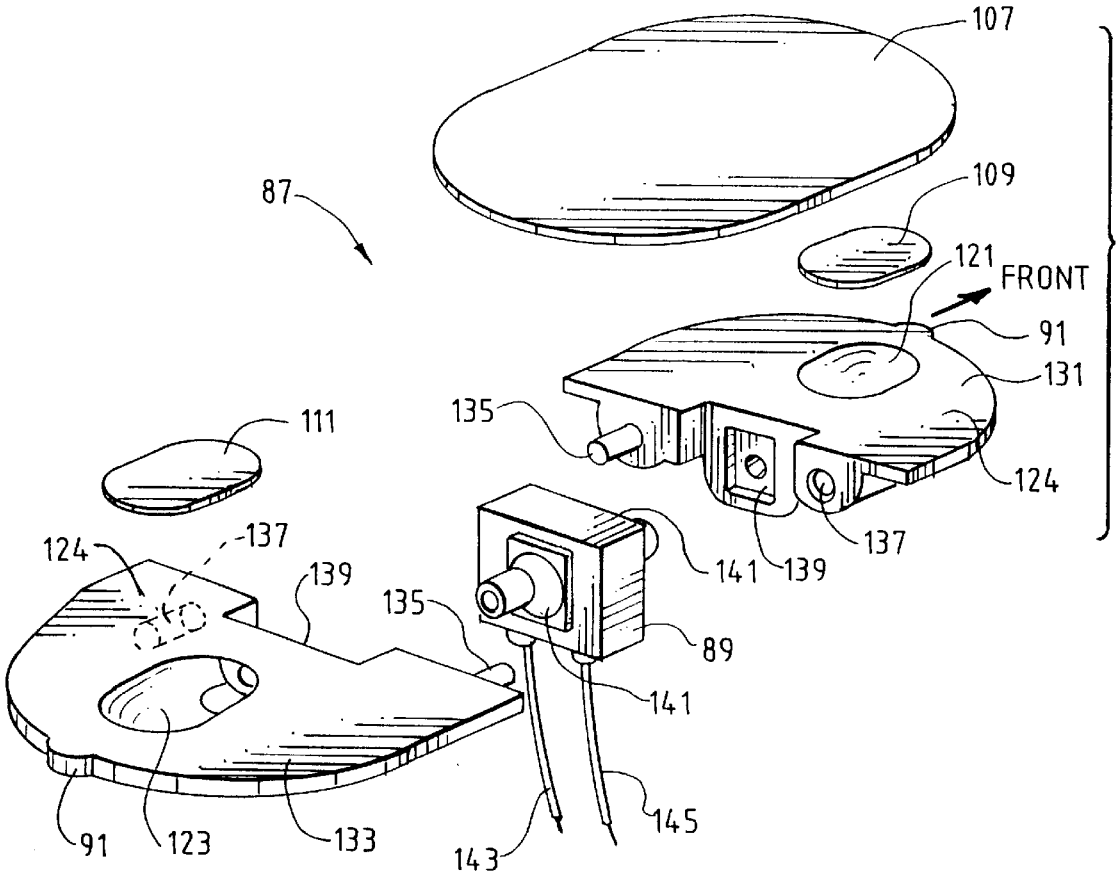
FIG. 13 is an exploded view of the microphone module of the present invention.

FIG. 13 is an exploded view of the microphone module 87 of the present invention. As can be seen in FIG. 13, housing 90 of FIG. 11 is comprised of two housing portions, 131 and 133. Portion 131 has a recess 121 located therein and portion 133 has a recess 123 located therein. Each of portions 131 and 133 includes a mating member 135 and a mating recess 137, a pocket 139 and an index tab 91. Alternatively, one portion could include both mating members and the other portion could include both mating recesses. Similarly, of course, one portion could include both index notches.

Upon assembly, the housing portions 131 and 133 are brought together with the microphone element located therebetween. The mating members 135 engage mating recesses 137 and the housing portions 131 and 133 are snapped together, at which point surfaces 141 of microphone element 89 contact surfaces in the pockets 139. As mentioned above, sealing material, such as glue, for example, can be used between surfaces 141 and the surfaces in pockets 139 to form an acoustic seal. Acoustic plugs 109 and 111 are then placed in recesses 121 and 123, respectively, and windscreen 107 is adhered to top surface 124, as discussed above. Wires 143 and 145 are then ready to be connected to the printed circuit board 81, or to such other electrical connection dictated by the desired mounting arrangement.

Figure 14A:
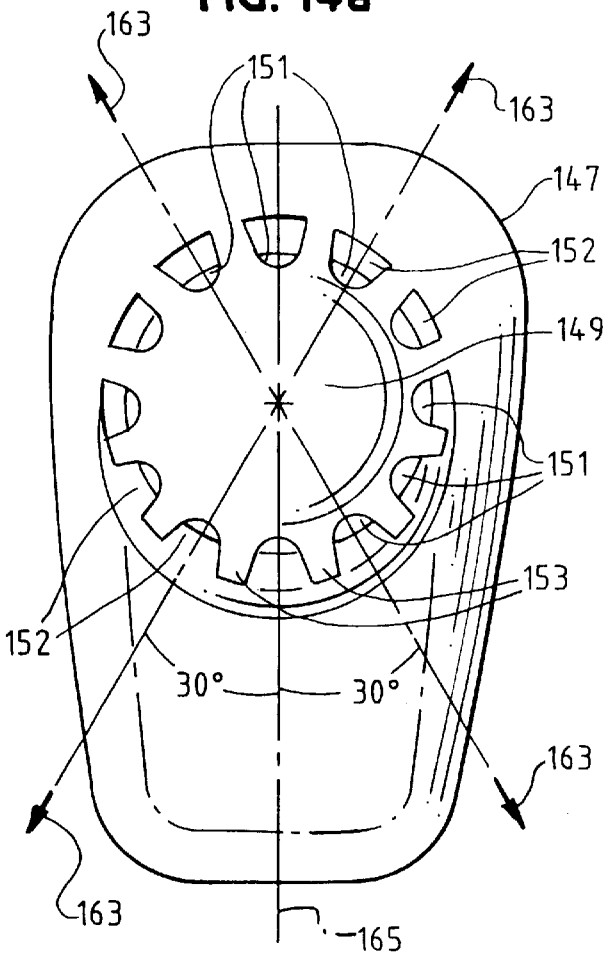
FIGS. 14*a* and 14*b* illustrate an alternate embodiment of the cover and removable module of the directional microphone assembly of the present invention.
Figure 14B:
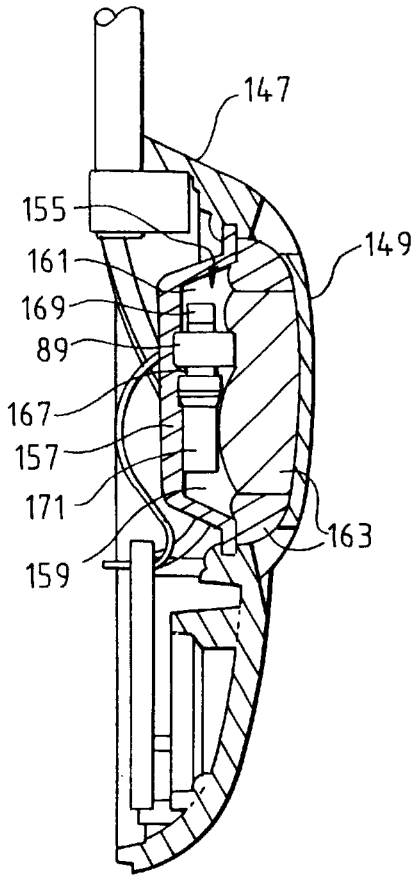
Figure 15:
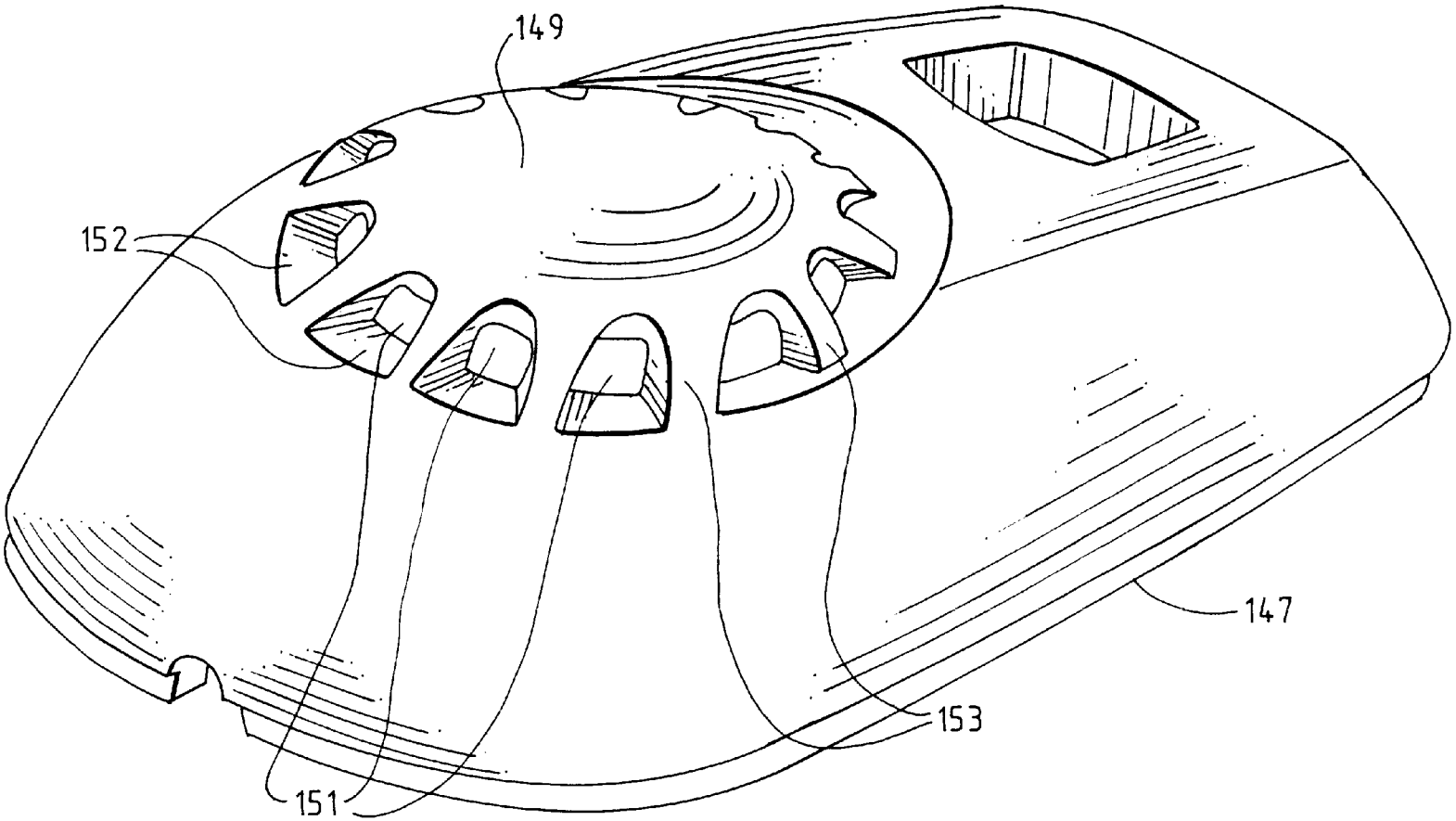
FIG. 15 is a top view of the cover of the alternate embodiment.

FIGS. 14*a* and 14*b* illustrate an alternate embodiment of the cover and removable module of the directional microphone assembly of the present invention. FIG. 14*a* is a top view, and FIG. 14*b* is a side cross-sectional view, of a cover 147 for a case similar to case 23 described above. Cover 147 has a protruding or bubble portion 149. As can be seen in FIG. 14*a* and FIG. 15, the protruding portion 149 includes acoustic openings 151, where sound enters the case, and acoustically opaque portions 153. Each acoustic opening 151 has a surface 152 adjacent thereto.

Cover 147 also includes a removable module or cup 157 mounted in the cover 147. As described more completely below, the removable module includes a microphone element 89 mounted in a recess 155 of the removable module 157. As discussed above, the microphone element 89 is electrically connected to the vehicle radio/telephone system via a cable and a printed circuit board. Arrows 163 in FIG. 14*a* show four potential orientations of the removable module 157, and thus the orientation of the microphone element 89, in the cover 147, each orientation being 30° off of reference axis 165.

The removable module 157 also includes front and rear sound inlet paths 159 and 161, respectively, that acoustically couple the acoustic openings 151 to front and rear inlet ports or tubes 167 and 169 of the microphone element 89. As explained more completely below, front inlet port 167 also has extension tube 171 acoustically coupled thereto. The sound inlet paths 159 and 161 each have a controlled resonance to achieve a desired directional characteristic. In addition, the combination of recess 155 of the removable module 157 and the open space underneath protruding portion 149 provides an acoustic volume in which a windscreen 163 can be mounted, while still maintaining a desired directional characteristic.

FIG. 16 illustrates the windscreen 163, which may be comprised of two portions—a ring portion 173 and a plug portion 175. The portions 173 and 175 may both be made of an open cell acoustic foam material, each portion having different porosity. For example, the plug portion 175 may be an open cell reticulated foam material having 30 PPI (pores per inch). The ring portion 173 may be a 2 to 1 compression (felted) open cell foam material having 100 PPI. As is apparent in this example, the plug portion 175 is more porous than the ring portion 173.

Ring portion 173 of windscreen 163 may have an outer diameter "D" of approximately 0.800 to 0.820 inches and an inner diameter "d" of approximately 0.562 inches. Plug portion 175 may likewise have an outer diameter D' of approximately 0.562 inches. Upon assembly, the plug portion 175 is fitted into the center of the ring portion 173, and both are placed as a unit between an inner surface of the cover 147 and the removable module 157.

It is also contemplated that ring portion 173 may instead be of toroid shape, and/or may also be placed in the case without the plug portion 173 so that open air exists underneath protruding portion 149 and inside ring/toroid portion 173.

FIG. 17 is a cross-sectional view of the removable module 157 and windscreen 163 mounted in the cover 147. As can be seen, the plug portion 175 becomes compressed between an inner surface 177 of protruding portion 149 and microphone element 89 and extension tube 171. Ring portion 173 likewise becomes compressed between inner surface 181 of protruding portion 149 and surface 185 of removable module 157. Portions of ring portion 173 and plug portion 175 extend into front and rear sound inlet paths 159 and 161.

FIG. 17 also illustrates acoustic openings 151 and adjacent surfaces 152. As can be seen, surfaces 152 may be sloped at an angle of 0–15° off of horizontal axis 187.

As mentioned above, front inlet port 167 has an extension tube 171 acoustically coupled thereto. Extension tube 171 assists in controlling both the sensitivity and directional characteristic of the microphone assembly. The volume associated with rear inlet port 169 and the volume within the rear portion of the microphone cartridge forms a resonant element. The same holds true for the front volume associated with front inlet port 167 and the volume within the front portion of the microphone element. However, the volumes within the front and rear portions of microphone element 89 may not be the same. Accordingly, extension tube 171 is used to add inertance to the front inlet port or tube 167. The net effect achieved is two resonant frequencies. In other words, the front and rear volumes are brought closer together by the addition of extension tube 171. A net result is an extension of the frequency of the desirable polar and directional shape of the frequency response. In addition, the extension tube 171 optimizes the distance between the front and rear entry ports to help achieve design sensitivity goals.

The microphone element 89 with extension tube 171 is tuned in conjunction with the volumes of the recess 155 in the removable module 157 and the open air space underneath protruding portion 149 and above removable module 157. In other words, the performance of microphone element 89 with the extension tube 171 is optimized when it is assembled in the case but non-optimized for application in free space (outside of the case). Optimization, as such, may be achieved by selecting an acoustic resistance for placement in the rear inlet tube 169 that takes into account, again, the volumes of the recess 155 in the removable module 157 and the open air space underneath protruding portion 149 and above removable module 157.

Figure 19:
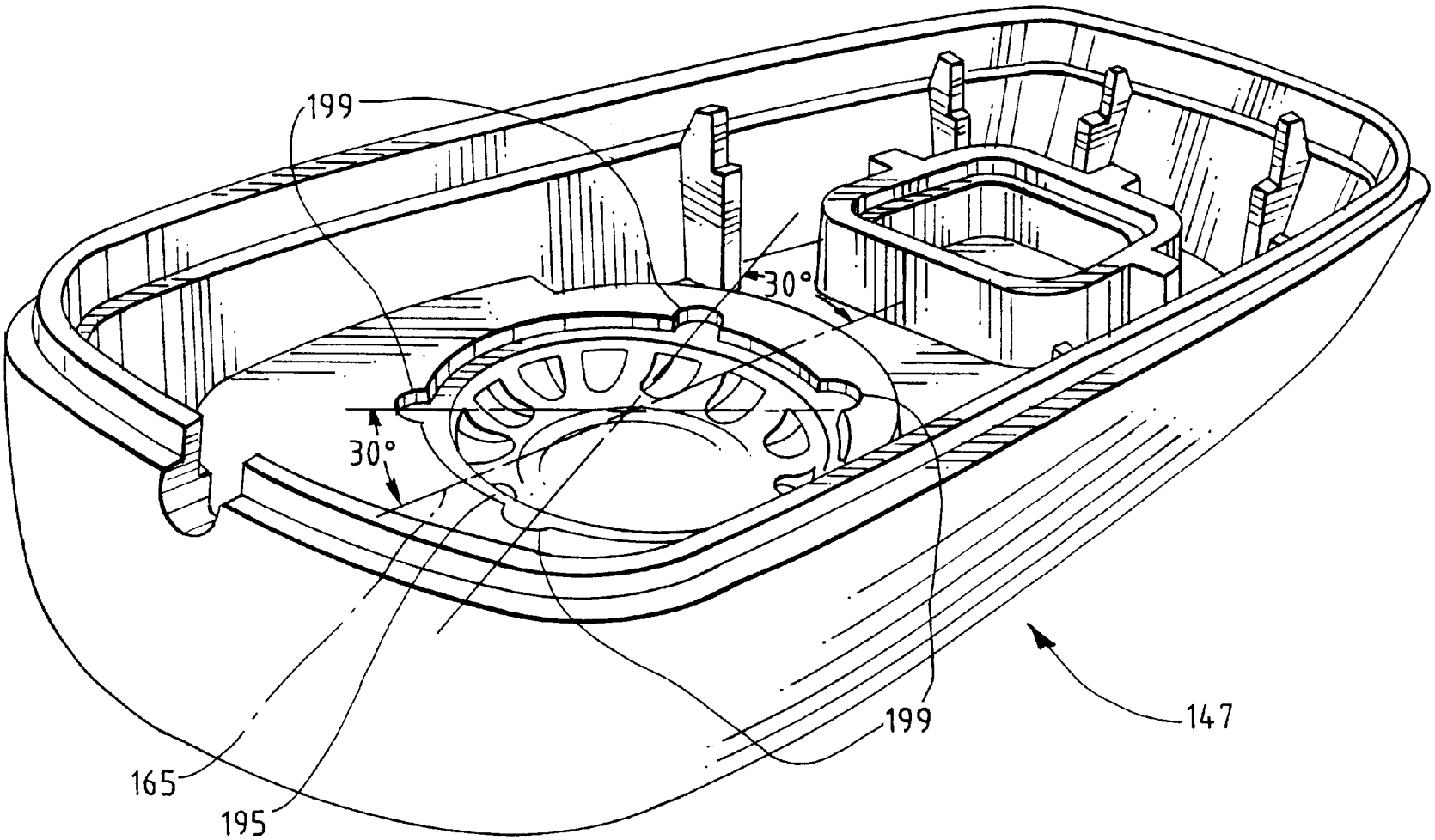
FIG. 19 illustrates the inside of the cover with the removable module removed therefrom.

FIG. 18 illustrates the removable module 157 removed from the case 149. Removable module 157 includes a pocket 189 at the bottom of recess 155 for mounting the microphone element 89. Removable module 157 also includes a mechanical support 191 for mounting extension tube 171. A mating surface 193 mates with a corresponding mounting surface 195 (see FIG. 19) within cover 147. Index tab 197 is engaged with one of index notches 199 (see FIG. 19), located at various positions around the mounting surface 195 and within cover 147. Thus, the removable module, and thus the microphone element 89, can be mounted and locked at various orientations within the cover, depending on the desired application. As mentioned above, the index notches 199 may be placed, for example, at four locations around the mounting surface 195, each location being 30° off of reference axis 165, as shown in FIG. 19. A sealing material may be used between mating surface 193 and mounting surface 195 to prevent acoustic leaking.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A directional microphone assembly comprising:

a removable directional microphone module;

a receiving unit adapted to releasably mount the removable directional microphone module in a plurality of different mounting positions, each of the plurality of different mounting positions being achieved at least in part by rotation of the removable directional microphone module about an axis and relative to the receiving unit, the removable directional microphone module generating a different polar directivity in each of the plurality of different mounting positions that corresponds to an angle of rotation of the removable directional microphone module about the axis; and the removable directional microphone module and the receiving unit together comprising a locking arrangement that locks the removable directional microphone module in each of the plurality of different mounting positions, the locking arrangement preventing movement of the removable directional microphone module relative to the receiving unit when the removable directional microphone module is in each of the plurality of different mounting positions.

2. The directional microphone assembly of claim 1 wherein the removable directional microphone module comprises a directional microphone element having a front inlet port and a rear inlet port, a front sound inlet path acoustically coupled to the front inlet port, and a rear sound inlet path acoustically coupled to the rear inlet port.

3. The directional microphone assembly of claim 2 further comprising a windscreen located at least partially in the front and rear sound inlet paths.

4. The directional microphone assembly of claim 3 wherein the receiving unit further comprises a protruding portion and wherein the windscreen is compressed between an inner surface of the protruding portion and the directional microphone element.

5. The directional microphone assembly of claim 1 further comprising a windscreen located in the receiving unit.

6. The directional microphone assembly of claim 2 further comprising an extension tube acoustically coupled to the front inlet port.

7. The directional microphone assembly of claim 2 wherein the microphone module further comprises an acoustic resistor located in the rear inlet port.

8. The directional microphone assembly of claim 5 wherein the windscreen is comprised of at least one type of open cell acoustic foam.

9. The directional microphone assembly of claim 5 wherein the windscreen is comprised of at least two portions.

10. The directional microphone assembly of claim 9 wherein the windscreen is comprised of two portions, and wherein one portion is a ring and the other portion is a plug that fits into the ring.

11. The directional microphone assembly of claim 10 wherein the ring portion is comprised of a first type of open cell acoustic foam and the plug portion is comprised of a second type of acoustic foam.

12. The directional microphone assembly of claim 11 wherein the second type of open cell acoustic foam is more porous than the first type of acoustic foam.

13. The directional microphone assembly of claim 2 wherein the front and rear sound inlet paths have a controlled resonance in a desired sound pickup frequency range.

14. The directional microphone assembly of claim 2 wherein the removable directional microphone module further comprises a recess, and wherein the directional microphone element is mounted in the recess.

15. The directional microphone assembly of claim 14 further comprising a mechanical support located in the recess for mounting an extension tube.

16. The directional microphone assembly of claim 1 wherein the plurality of different mounting positions are discretely spaced.

17. The directional microphone assembly of claim 1 wherein the plurality of different mounting positions are substantially equally spaced from a reference axis.

18. The directional microphone assembly of claim 17 comprising four mounting positions.

19. The directional microphone assembly of claim 1 further comprising at least one mounting surface, and wherein the locking arrangement comprises a plurality of index notches located in the receiving unit and at least one index tab located in the removable directional microphone module, the at least one index tab engaging at least one of the plurality of index notches in mating relation when the removable directional microphone module is mounted on the at least one mounting surface.

20. The directional microphone assembly of claim 19 wherein the mounting surface is generally circular in shape and the index notches are located around the mounting surface.

21. The directional microphone assembly of claim 20 wherein an index notch is located at every 30° angle from a reference axis.

22. The directional microphone assembly of claim 20 wherein the index notches are equally spaced from a reference axis.

23. A directional microphone assembly comprising:

a removable directional microphone module;

a receiving unit;

a mounting system that releasably mounts the removable directional microphone module at a plurality of different directional mounting positions within the receiving unit, each of the plurality of different directional mounting positions being achieved at least in part by rotation of the removable directional microphone module about an axis and relative to the receiving unit, the removable directional microphone module generating a different polar directivity in each of the plurality of different mounting positions that corresponds to an angle of rotation of the removable directional microphone module about the axis; and the mounting system being configured to lock the removable directional microphone module in each of the plurality of different directional mounting positions, the mounting system preventing movement of the removable directional microphone module relative to the receiving unit when the removable directional microphone module is in each of the plurality of different directional mounting positions.

24. The directional microphone assembly of claim 23 wherein the removable directional microphone module comprises a directional microphone element having front and rear inlet ports, a front sound inlet path acoustically coupled to the front inlet port, and a rear sound inlet path acoustically coupled to the rear sound inlet port.

25. The directional microphone assembly of claim 24 further comprising a windscreen located at least partially in the front and rear sound inlet paths.

26. The directional microphone assembly of claim 25 wherein the receiving unit further comprises a protruding portion and wherein the windscreen is compressed between an inner surface of the protruding portion and the directional microphone element.

27. The directional microphone assembly of claim 23 further comprising a windscreen located in the receiving unit.

28. The directional microphone assembly of claim 24 further comprising an extension tube acoustically coupled to the front inlet port.

29. The directional microphone assembly of claim 24 wherein the microphone module further comprises an acoustic resistor located in the rear inlet port.

30. The directional microphone assembly of claim 27 wherein the windscreen is comprised of at least one type of an open cell acoustic foam material.

31. The directional microphone assembly of claim 27 wherein the windscreen is comprised of at least two portions.

32. The directional microphone assembly of claim 31 wherein the windscreen is comprised of two portions, and wherein one portion is a ring and the other portion is a plug that fits into the ring.

33. The directional microphone assembly of claim 32 wherein the ring portion is comprised of a first type of open cell acoustic foam and the plug portion is comprised of a second type of acoustic foam.

34. The directional microphone assembly of claim 33 wherein the second type of open cell acoustic foam is more porous than the first type of acoustic foam.

35. The directional microphone assembly of claim 24 wherein the front and rear sound inlet paths have a controlled resonance in a desired sound pickup frequency range.

36. The directional microphone assembly of claim 24 wherein the removable directional microphone module further comprises a recess, and wherein the directional microphone element is mounted in the recess.

37. The directional microphone assembly of claim 36 further comprising a mechanical support located in the recess for mounting an extension tube.

38. The directional microphone assembly of claim 23 wherein the plurality of different directional mounting positions are discretely spaced.

39. The directional microphone assembly of claim 23 wherein the plurality of different directional mounting positions are substantially equally spaced from a reference axis.

40. The directional microphone assembly of claim 39 comprising four mounting positions.

41. The directional microphone assembly of claim 23 wherein the mounting system comprises a plurality of index notches and at least one mounting surface, and wherein the removable directional microphone module has at least one index tab, the at least one index tab engaging at least one of the plurality of index notches in mating relation when the mounting system mounts and locks the removable module.

42. The directional microphone assembly of claim 41 wherein the mounting surface is generally circular in shape and the index notches are located around the mounting surface.

43. The directional microphone assembly of claim 42 wherein an index notch is located at every 30° angle from a reference axis.

44. The directional microphone assembly of claim 42 wherein the index notches are equally spaced from a reference axis.

45. A directional microphone assembly comprising:

a removable directional microphone module;

a receiving unit;

a mounting system located in the receiving unit that releasably mounts and locks the removable directional microphone module at a plurality of different directional mounting positions within the receiving unit; and a windscreen comprised of at least two portions, and having a ring portion and a plug portion, the plug portion fitting into the ring portion.

46. The directional microphone assembly of claim 45 wherein the ring portion is comprised of a first type of open cell acoustic foam and the plug portion is comprised of a second type of open cell acoustic foam.

47. The directional microphone assembly of claim 46 wherein the second type of open cell acoustic foam is more porous than the first type of open cell acoustic foam.

* * * * *